United States Patent [19]

Brown

[11] Patent Number: 4,860,158

[45] Date of Patent: Aug. 22, 1989

[54] LOW PRESSURE METERING FLUID PUMP

[75] Inventor: Ralph V. Brown, Cayuta, N.Y.

[73] Assignee: Facet Enterprises, Inc., Tulsa, Okla.

[21] Appl. No.: 255,639

[22] Filed: Oct. 11, 1988

Related U.S. Application Data

[62] Division of Ser. No. 867,087, May 27, 1986, abandoned.

[51] Int. Cl.[4] ..... H01H 9/00

[52] U.S. Cl. ..... 361/165; 361/196; 361/203

[58] Field of Search ..... 361/161, 162, 165, 154, 361/160, 194, 196, 203; 307/117; 219/494, 501, 510, 514; 236/46 R, 46 C

[56] References Cited

U.S. PATENT DOCUMENTS

| | | | |
|---|---|---|---|
| 3,864,608 | 2/1975 | Normile et al. | 361/194 X |
| 4,047,852 | 9/1977 | O'Connor et al. | 417/415 |
| 4,673,127 | 6/1987 | Grant | 236/51 |

*Primary Examiner*—L. T. Hix
*Assistant Examiner*—David M. Gray
*Attorney, Agent, or Firm*—Remy J. VanOphem

[57] ABSTRACT

A low pressure metering pump having a hollow piston reciprocated in a cylindrical guide by a solenoid coil. A pair of check valves provide for unidirectional fluid flow through the cylindrical guide in response to the reciprocation of the piston. A seal attached to the piston prohibits a fluid backflow between the external surface of the piston and the internal surface of the cylindrical guide. A bumper seal at the output end of the piston prevents fluid flow through the cylindrical guide when the solenoid coil is de-energized. A control circuit periodically energizes the solenoid coil at a frequency determined by a variable resistance responsive to predetermined operational parameters. In a preferred embodiment, the metering pump is a fuel control element for a heater and the variable resistance is a thermistor or similar type of temperature sensitive resistance, which controls the rate at which fuel is delivered to the heater.

5 Claims, 2 Drawing Sheets

LOW PRESSURE METERING FLUID PUMP

This is a division of application Ser. No. 867,087 filed May 27, 1986, now abandoned.

BACKGROUND OF THE INVENTION

1. Field of the Invention

The invention is related to electromagnetic fluid pumps and in particular to metering fluid pumps having a controllable fluid output.

2. Description of the Prior Art

Reciprocating electromagnetic fluid pumps, such as those taught in L.C. Parker in U.S. Pat. No. 2,994,792 and E.D. Long in U.S. Pat. No. 3,361,069, used mechanical or magnetic switches to energize a solenoid to retract the piston or plunge when it reaches the end of its pumping stroke. These switches were unreliable and, therefore, their use has been discontinued. Currently, most of these reciprocating electromagnetic fluid pumps use electronic oscillators which energize the pump's solenoid at predetermined intervals. Some of these pumps use free-running oscillators, as taught by Kofinh in U.S. Pat. No. 3,211,798, or a blocking oscillator, as taught by Wertheimer in U.S. Pat. No. 3,381,616. Pumps with electronic oscillators operate at a constant speed and work well for a narrow band of output loads.

The invention is a low pressure metering fluid pump particularly suited for providing fuel to wick or carburetor type burners to control the heat output, as a function of an operator control or a temperature sensor.

SUMMARY OF THE INVENTION

The invention is a metering fluid pump which includes a housing having an inlet port and an outlet port, and a cylindrical guide disposed in the housing having an inlet end in fluid communication with the inlet port and an outlet end in fluid communication with the outlet port. A hollow cylindrical piston is disposed in the cylindrical guide for reciprocation therein, a resilient member is provided for biasing the piston toward the outlet end of the cylindrical guide, a solenoid coil circumscribing the cylindrical guide is provided for generating a magnetic force to displace the piston towards the inlet end, and valve assemblies are provided for producing a unidirectional fluid flow through the cylindrical guide in response to the reciprocation of the piston. An aperture member provided at the outlet end of the cylindrical guide defines an outlet aperture having a diameter smaller than the diameter of the cylindrical guide. An elastic bumper attached to the end of the piston facing the outlet end occludes the outlet aperture when the piston is displaced to its extreme position and a piston seal inhibits a fluid backflow between the external surface of the piston and the internal surface of the cylindrical guide. A control circuit periodically energizes the solenoid coil at a controllable frequency to control the quantity of fluid being delivered by the pump.

The object of the invention is an electromagnetic pump providing a metered fluid output flow. Another object is a pump in which the fluid flow rate is controllable. Still another object of the invention is a pump in which the fluid flow is controlled by a sensed parameter. A final object of the invention is a fluid pump in which the outlet aperture is sealed when the pump is de-energized to prevent syphoning or fluid drainage through the pump. These and other objects of the present invention will become more apparent from reading the specification in conjunction with the drawings appended hereto.

DETAILED DESCRIPTION OF THE PREFERRED EMBODIMENT

Figure 1:
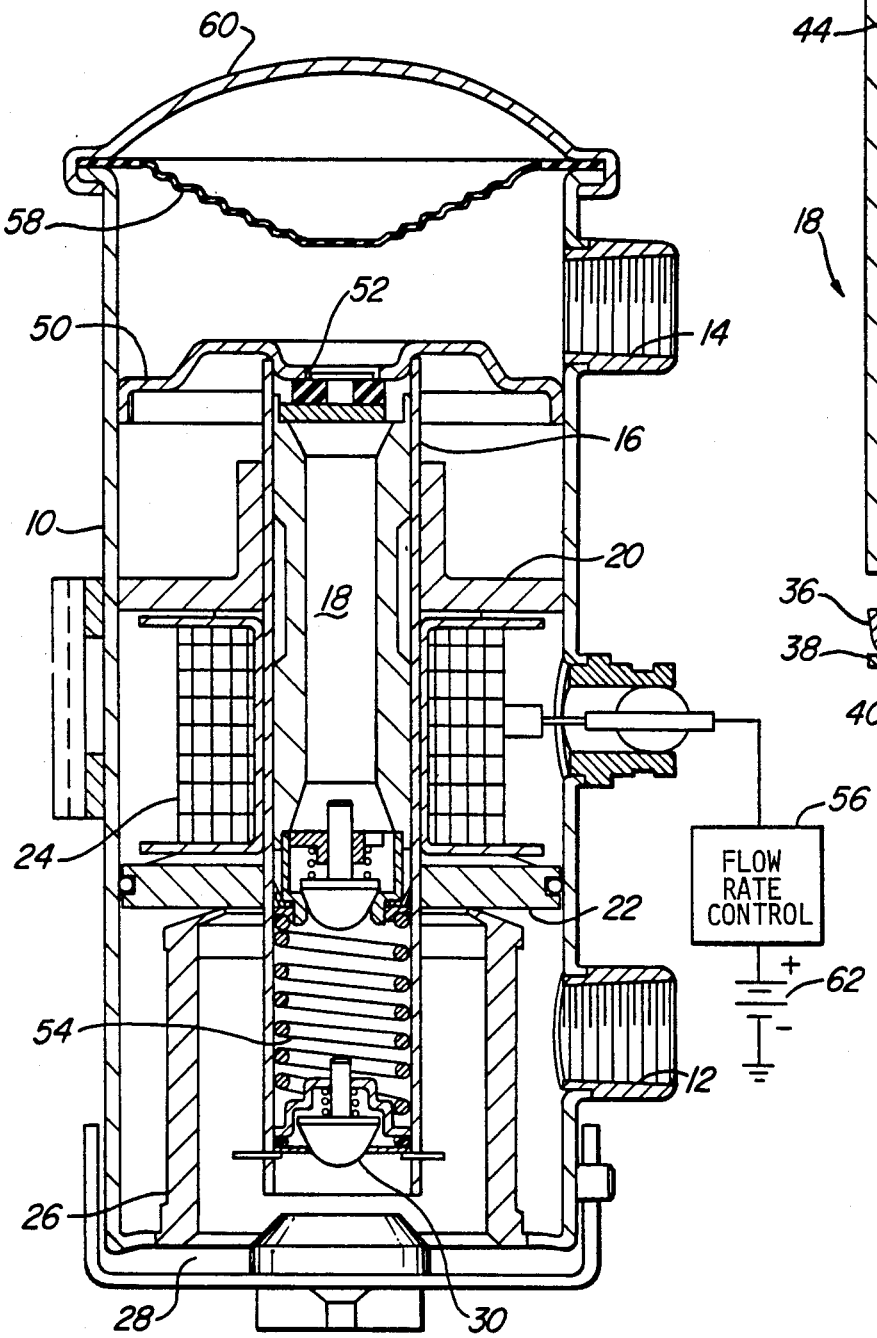
FIG. 1 is a cross-sectional side view of the metering pump.

The basic elements of the low pressure metering fluid pump are shown in FIG. 1. The pump includes a generally cylindrical housing 10 having a fluid inlet port 12 and a fluid outlet port 14. Contained within the housing 10 is a non-magnetic cylindrical guide 16 which forms a guide for a reciprocating piston assembly 18. The cylindrical guide 16 is supported in the housing 10 by a pair of annular pole members 20 and 22, respectively. A solenoid coil 24 circumscribes the cylindrical guide 16 intermediate the poles 20 and 22. An annular fluid filter 26 circumscribes the cylindrical guide between the pole member 22 and the bottom 28 of the housing 10 to remove any particulates suspended in the fluid which pass through the inlet port 12.

Figure 2:
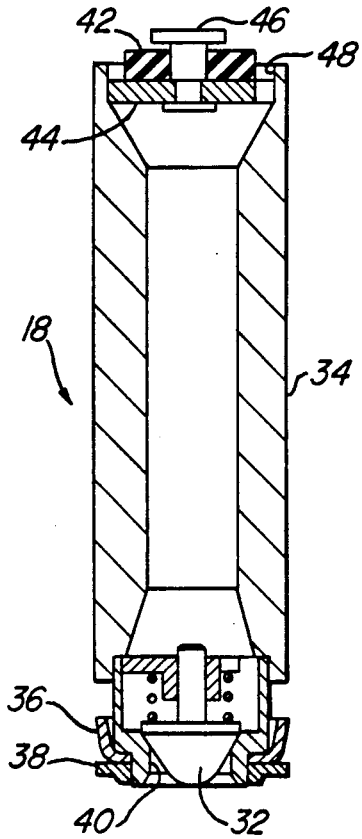
FIG. 2 is an enlarged cross-section of the piston assembly.

A first valve assembly 30 is provided in the entrance aperture of the cylindrical guide 16. A second valve assembly 32 is disposed at the end of the piston assembly's hollow cylindrical piston member 34, as shown in FIG. 2. The first and second valve assemblies cooperate with the reciprocation of the piston assembly to provide a unidirectional fluid flow through the pump. A cupshaped resilient seal 36 is secured to the second valve assembly 32 by an annular retainer 38 pressed onto the cylindrical end of a valve support bracket 40. Preferably the seal 36 is made from an elastomeric material, such as VITRON®. The outer diameter at the open end of the cupshaped resilient seal 36 is approximately equal to the inner diameter of the cylindrical guide 16. In operation, pressurized fluid leaking back between the piston member 34 and the inner surface of the cylindrical guide 16 will be trapped by the seal 36. The increased pressure will expand the seal's open end to forceably engage the inner wall of the cylindrical guide and inhibit any backflow leakage past the piston member 34 during the pumping stroke. This ensures that a precise quantity of fluid will be output during each pumping stroke.

Figure 3:
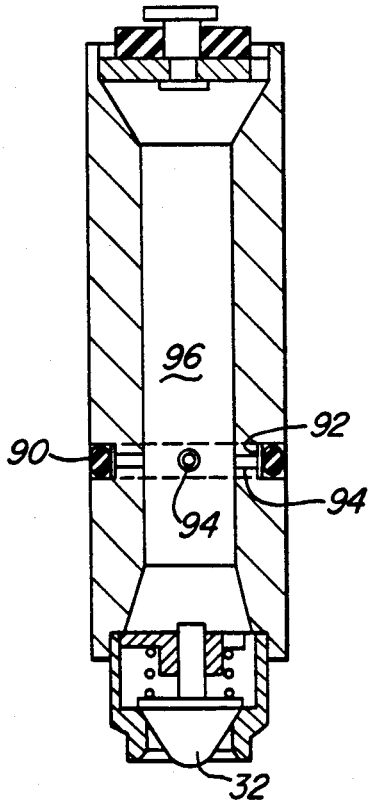
FIG. 3 is a cross-section of an alternate embodiment of the piston assembly.

Alternatively, the seal 36 may be replaced by a resilient ring seal 90 disposed in a circumferential groove 92 provided at an intermediate location along the length of the piston member 34, as shown in FIG. 3. One or more radial fluid channels 94 connect the groove 92 with the interior of the piston member 34. During the pumping stroke of the piston member 34, the fluid pressure inside of the piston member's hollow interior 96 increases. The increased pressure is communicated to the inner surface of the resilient ring seal 90 through the fluid channels 94 causing its diameter to increase and engage the inner surface of the cylindrical guide 16. This will inhibit any fluid back-flow between the external surface of the piston member 34 and internal surface of the cylindrical guide 16. Preferably, the resilient ring seal 90 is made from a fuel resistant elastomer, such as VITRON®.

An output seal 42 is disposed at the other end of the piston member 34. The output seal 42 is preferably made from an elastomer, such as VITRON® or a similar material which is resistant to hydrocarbon fuels. The output seal 42 is attached to a spider-like support bracket 44 by a rivet 46. Alternatively, the output seal may be bonded directly to the bracket 44 using an epoxy or adhesive resistant to hydrocarbon fuels as is known in the art. The bracket 44 is pressed into a counterbore 48 provided at the end of the piston member 34 to secure it in place.

Returning to FIG. 1, the output end of the cylindrical guide 16 is supported in the housing 10 by an annular separator plate 50. The separator plate 50 partially encloses the output end of the cylindrical guide 16 and defines an exit aperture 52 which has a diameter smaller than the diameter of the output seal 42. As shown in FIG. 1, when the piston assembly 18 is fully displaced towards the output end of the cylindrical guide 16, the output seal 42 engages the separator plate 50 about the periphery of the exit aperture 52 inhibiting a fluid flow through the pump in either direction. This will prohibit syphoning or drainage of fluid from the fluid source to the utilization device, such as a carburetor or wicktype burner, or vice versa when the pump is deactivated or de-energized. This is a fail-safe feature which makes this pump particularly suitable for heaters or similar devices where syphoning or fuel drainage could present a potential fire or toxic fume hazard.

A resilient member, such as a coil spring 54, is disposed in the cylindrical guide 16 between the first valve assembly 30 and the piston assembly 18. The coil spring 54 produces a force urging the piston assembly 18 towards the output end of the cylindrical guide 16 and the output seal into engagement with the separator plate 50. A flow rate control circuit 56 connected to a source of electrical power, illustrated as battery 62, periodically energizes the solenoid coil 24 to produce the desired metered fluid flow through the pump. Energizing of the solenoid coil 24 will displace the piston assembly 18 towards the input end of the cylindrical guide 16 against the force produced by the coil spring 54. During the displacement of the piston assembly 18 by the solenoid coil 24, the fluid trapped in the cylindrical guide 16 above the first valve assembly 30 will open the second valve assembly 32 allowing the trapped fluid to enter into the hollow portion of the piston member 34. Upon de-energizing of the solenoid coil 24, the coil spring 54 will urge the piston assembly 18 towards the output end of the cylindrical guide. This will close the second valve assembly 32 and the first valve assembly 30 will open allowing fluid from a fluid source (no shown) to enter the volume inside the cylindrical guide 16 above the valve assembly 30.

A flexible diaphragm 58 seals the top of the pump housing 10 and forms in conjunction with the separator plate 50 an accumulator, which reduces pressure surges and smooths out the fluid flow from the pump's outlet port 14. A rigid cover 60 attached to the top of the housing 10 protects the flexible diaphragm 58 from physical damage from external forces.

Figure 4:
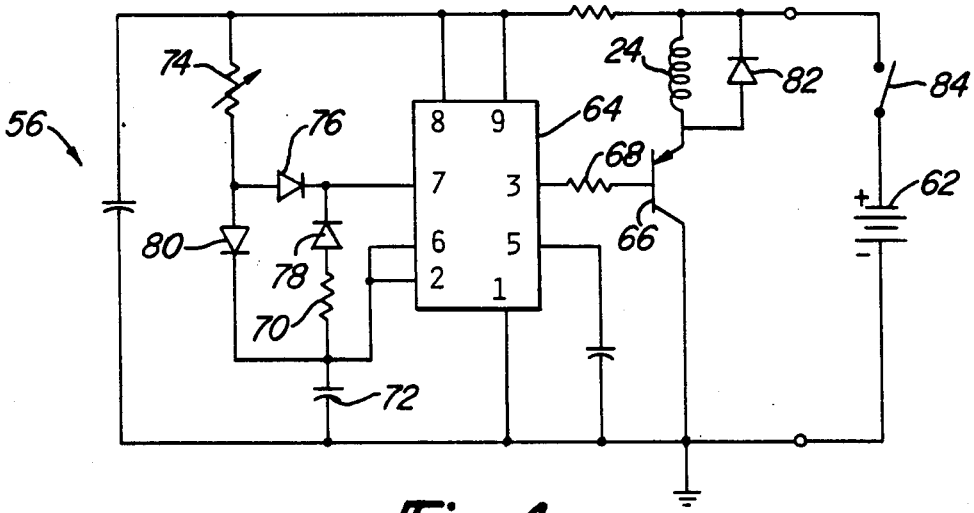
FIG. 4 is a circuit diagram of the control circuit.

The details of the flow rate control circuit 56 as shown in FIG. 4. In the preferred embodiment, the flow rate control circuit 56 includes an integrated circuit timer 64, such as integrated timer 555 produced by International Semiconductor, Inc., and various other manufacturers of semiconductor products. The signal output terminal of the timer 64 (terminal 3) is connected to the base of a transistor 66 through a resistance 68. The transistor 66 may be a single power transistor or a Darlington Amplifier, as is known in the art. The transistor 66 is connected in series with the pump's solenoid coil 24 between the positive and negative terminals of the battery 62. The emitter of the transistor 66 is connected to one end of the solenoid coil 24 and the collector is connected to the negative terminal of the battery 62. A resistance 70 connected between the timer 64 control input terminals (terminals 2 and 6) and the timer 64 control output terminal (terminal 7) in conjunction with a capacitance 72 controls the length of time that the solenoid coil 24 is energized. The values of the resistance 70 and capacitance 72 are selected so that the solenoid coil 24 is energized for a period of time sufficient to fully retract the piston assembly 18. When the piston assembly is fully retracted before the beginning of each pumping stroke, all the pumping strokes will be of the same length and, therefore, deliver a precise metered amount of fluid.

Figure 5:
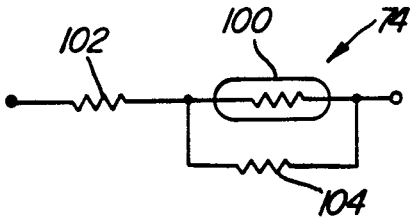
FIG. 5 is a schematic view of a first alternate embodiment of the variable resistance.
Figure 6:
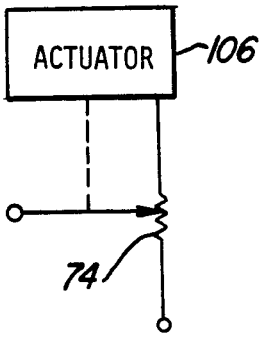
FIG. 6 is a schematic view of a second alternate embodiment of the variable resistance.

A variable resistance 74 connected between the positive terminal of the source of electrical power, the battery 62, and the control output terminal (terminal 7) of the timer 64, controls the frequency at which the solenoid coil 24 is energized. Since each pumping stroke delivers a precise quantity of fluid, the frequency of the pumping strokes determines the rate at which the fluid is delivered. In the preferred embodiment, the variable resistance 74 may be a thermistor 100 or thermistor network, such as shown in FIG. 5 in which fixed resistors 102 and 104 are connected in series and/or parallel with a thermistor 100 to tailor the resistance-temperature characteristics of the thermistor 100. Since the resistance of the thermistor or thermistor network is variable, it can be used to control the rate at which fluid is being delivered to a particular apparatus, such as the fuel to oil or gasoline heaters. In an alternative embodiment, the variable resistance 74 may be actuated by a bi-metal thermostat or any other type of actuator 106, as shown in FIG. 6, or may be a manually actuated variable resistor. Diodes 76, 78 and 80 are provided to minimize the effect of changing the value of the resistance 74 on the duration of the signal activating the solenoid coil. As is known in the art, a diode 82 is provided across the terminals of the solenoid coil 24 to dissipate the inductive flyback generated by the solenoid coil when it is de-energized. A switch 84 connected between the battery 62 and the flow rate control circuit 56 is an "on-off" switch controlling the energizing the metering fluid pump.

In operation, closing the switch 84 initiates the charging of the capacitance 72 through variable resistance 74 and diode 80. When a predetermined voltage is developed across the capacitance 72, the terminal 7 of the timer 64 assumes a ground potential. Simultaneously, the terminal 3 goes negative rendering the transistor 66 conductive and energizing the solenoid coil 24. The ground potential at the terminal 7 initiates the discharge of the capacitance 72 through the resistance 70 and the diode 78. The ground potential at the terminal 7 also grounds the junction between the variable resistance 74 and the diode 80 so that the charging of the capacitance 72 through the diode 80 is terminated. After a period of time determined by the resistance 70 and the capacitance 72, the potential applied to the terminal 2 of the timer 64 will cause the terminal 7 to assume an open circuit state and the signal at the terminal 3 will go high turning the transistor 66 off. The open circuit state at the terminal 7 will terminate the discharge of the capacitance 72 through the resistance 70 and will initiate the recharging of the capacitance 72 through the variable resistance 74 and the diode 80. This cycle will be repeated as long as the switch 84 remains closed.

As can be seen from the above description of the operation of the control circuit, the solenoid coil is always energized for identical time periods and the resistance value of the variable resistance 74 has no affect on these time periods. The only effect of the variable resistance 74 is to control the frequency at which the solenoid coil 24 is energized.

Having described the low pressure metering fluid pump in detail, it is recognized that persons skilled in the art make changes in the design of the pump or the control circuit without departing from the spirit of the invention described above and set forth in the appended claims.

What is claimed is:

1. A control circuit for periodically energizing the solenoid coil of an electromagnetic actuator comprising:

an electronic timer circuit having a first and second control input terminal, a control output terminal and a signal output terminal;

a capacitance connected between said first and second control input terminals and a common ground;

a serially connected variable resistance and first diode connected between a source of electrical power and said capacitance for charging said capacitance at a rate determined by the resistance value of said variable resistance;

a second diode having a cathode connected to said control output terminal and an anode connected to the junction between said variable resistance and said first diode;

a fixed resistance connected between said capacitance and said control output terminal for discharging said capacitance at a rate determined by said fixed resistance; and a power transistor connected in series with said solenoid coil between said source of electrical power and said common ground, the base of said power transistor being connected to said signal output terminal.

2. The control circuit of claim 1 having a third diode connected between said control output terminal and said fixed resistance, said third diode having its cathode connected to said control output terminal and its anode connected to said fixed resistance.

3. The control circuit of claim 1 wherein said variable resistance is a thermistor.

4. The control circuit of claim 1 wherein said variable resistance is a thermistor network comprising at least one thermistor and at least one fixed resistance in circuit relationship with said thermistor.

5. The control circuit of claim 1 wherein said variable resistance is actuated by a sensor actuator to change its resistance value.

* * * * *

UNITED STATES PATENT AND TRADEMARK OFFICE

CERTIFICATE OF CORRECTION

PATENT NO. : 4,860,158

DATED : August 22, 1989

INVENTOR(S) : Ralph V. Brown

It is certified that error appears in the above-identified patent and that said Letters Patent is hereby corrected as shown below:

Column 1, line 14, delete "in" and insert ---- by ----. (1st occurrence)

Column 1, line 17, delete "plunge" and insert ---- plunger ----.

Column 2, line 24, delete "non-magnetic" and insert ---- nonmagnetic ----.

Column 3, line 58, after "the" insert ---- first ----.

Column 3, line 66, delete "as" and insert ---- are ----.

Column 4, line 36, delete "a" and insert ---- the ----.

Column 4, line 53, after "energizing" insert ---- of ----.

Column 4, line 56, after "through" insert ---- the ----.

Column 4, line 57, after "and" insert ---- the ----.

Column 5, line

Signed and Sealed this

Second Day of April, 1991

*Attest:*

*Attesting Officer*

HARRY F. MANBECK, JR.

*Commissioner of Patents and Trademarks*